US008328584B2

(12) United States Patent
Lynch et al.

(10) Patent No.: US 8,328,584 B2
(45) Date of Patent: Dec. 11, 2012

(54) SYSTEMS AND METHODS FOR PROVIDING A TRIMLESS ELECTRONIC DEVICE PORT

(75) Inventors: Stephen Brian Lynch, Portola Valley, CA (US); Emery Sanford, San Francisco, CA (US); Cameron Frazier, Chicago, IL (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/197,040

(22) Filed: Aug. 3, 2011

(65) Prior Publication Data

US 2011/0287669 A1 Nov. 24, 2011

Related U.S. Application Data

(63) Continuation of application No. 12/825,686, filed on Jun. 29, 2010, now Pat. No. 8,011,970, which is a continuation of application No. 12/188,735, filed on Aug. 8, 2008, now Pat. No. 7,771,240.

(60) Provisional application No. 60/995,365, filed on Sep. 25, 2007.

(51) Int. Cl.
*H01R 24/04* (2006.01)

(52) U.S. Cl. ..... 439/668; 361/679.02; 174/524

(58) Field of Classification Search ..... 439/668; 174/50.56, 524; 29/592.1, 620, 887
See application file for complete search history.

(56) References Cited

U.S. PATENT DOCUMENTS

| | | | | |
|---|---|---|---|---|
| 4,964,814 | A | 10/1990 | Tengler et al. | |
| 5,175,928 | A | 1/1993 | Grabbe | |
| 5,831,816 | A | 11/1998 | Johns et al. | |
| 6,283,792 | B1 | 9/2001 | Tolmie et al. | |
| 6,478,625 | B2 | 11/2002 | Tolmie et al. | |
| 6,574,098 | B2 * | 6/2003 | Netzel et al. | 361/679.3 |
| 6,612,857 | B2 | 9/2003 | Tolmie | |
| 6,821,146 | B2 | 11/2004 | Tolmie | |
| 7,156,690 | B2 | 1/2007 | Tolmie | |
| 2004/0175993 | A1 | 9/2004 | Chennakeshu | |
| 2005/0255249 | A1 | 11/2005 | Schlatterbeck et al. | |
| 2007/0172664 | A1 | 7/2007 | Peng et al. | |
| 2008/0106857 | A1 | 5/2008 | Huang | |

* cited by examiner

*Primary Examiner* — Vanessa Girardi
(74) *Attorney, Agent, or Firm* — Dorsey & Whitney LLP

(57) ABSTRACT

This invention is directed to systems and methods for providing a port in an electronic device housing that is electrically isolated from a conductive portion of a connector inserted in the port without the use of a nonconductive trim in the port. In some embodiments, the connector may include a non-conductive flange or ring operative to contact the housing and the portions of the housing within the port. In some embodiments, a thin layer of non-conductive material may be applied to the portions of the housing within the port to prevent conductive portions of the connector from coming into contact with the housing (e.g., and grounding the conductive portion. This invention may be of particular interest when the conductive portion that may come into contact with the housing is not used to ground the connector.

19 Claims, 4 Drawing Sheets

SYSTEMS AND METHODS FOR PROVIDING A TRIMLESS ELECTRONIC DEVICE PORT

CROSS-REFERENCE TO RELATED APPLICATION

This application is a continuation of U.S. application Ser. No. 12/825,686, filed Jun. 29, 2010 (issued as U.S. Pat. No. 8,011,970 on Sep. 6, 2011), which is a continuation of U.S. application Ser. No. 12/188,735, filed Aug. 8, 2008 (issued as U.S. Pat. No. 7,771,240 on Aug. 10, 2010), which claims the benefit of U.S. Provisional Application No. 60/995,365, filed Sep. 25, 2007, which are fully-incorporated by reference herein in their entirety.

BACKGROUND OF THE INVENTION

This invention is directed to systems and methods for providing a trimless electronic device port into which a connector may be inserted. For example, this invention may be directed to a trimless audio jack operative to receive an audio plug.

The functionality of electronic devices may be enhanced by providing one or more ports to which accessory devices may connect. For example, some electronic devices may include audio jacks into which audio plugs may be inserted. The audio plugs may be connected to an audio generation component (e.g., speakers, headsets or ear buds) operative to provide audio received from the electronic device to a user. As another example, some electronic devices may include data ports into which power or data transfer connectors may be inserted (e.g., USB or 30-pin connectors).

To enhance the aesthetic appearance of the electronic device, it may desirable to provide a trimless port. In other words, it may desirable that the housing of the electronic device form the outermost and visible surface adjacent to the port, and that no other material or component extends from the port to or past the surface of the housing. If the housing is constructed from a metal or other conductive material, however, one or more conductive portions of the connector may come into contact with the housing and cause the connector to short or otherwise degrade the connector's ability to transfer data. If the connector is an audio jack, the contact between the jack and the housing may cause electrical noise or static and impede the user's experience.

SUMMARY OF THE INVENTION

An electronic device having a trimless port for receiving a connector is provided. In some embodiments, a plug having a non-conductive ring operative to be placed in contact with the housing near the port may be provided.

An electronic device housing constructed from an electrically conductive material may be provided. The housing may include an outer surface and a port forming a hole in the outer surface through which a connector may pass. A thin coating may be applied along the surface of the walls of the hole to electrically isolate a connector inserted in the port from the electronic device housing. The coating may be applied to the housing using any suitable process, and may include any suitable material. In some embodiments, the coating may be less than 0.1 mm thick.

A connector for use in an electronic device having a conductive housing into which the connector is inserted is provided. The connector may include at least one conductive portion operative to be electrically coupled to the electronic device (e.g., to provide data, audio or power signals). The connector may in addition include a non-conductive portion surrounding the periphery of the at least one conductive portion. The non-conductive portion may be positioned such that it may be placed in contact with the housing when the connector is inserted in the electronic device. The non-conductive portion may thus isolate the conductive portion from contacts with the electronic device housing.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION

An electronic device may include one or more ports operative to receive a connector. For example, the electronic device may include one or more ports for audio connectors (e.g., audio jacks), data connectors (e.g., USB or 30-pin connectors), power connectors (e.g., a MagSafe connector), or any other suitable connector. To enhance the aesthetic appearance of the ports, the electronic device housing may form the entirety of the visible portion of the port. If the housing is constructed from a metal or conductive material, however, a conductive portion of a connector may contact the housing and cause the connector to short.

Several approaches may be used to prevent the conductive portion of the connector from contacting the conductive housing adjacent to the port. In some embodiments, a non-conductive trim may be inserted around the periphery of the housing. The trim may then be visible, however, which may detract from the aesthetic appearance of the electronic device. In some embodiments, a non-conductive surface may be embedded along the base of the connector (e.g., where the connector would contact the housing) to prevent unwanted electrical contacts between the connector and the housing.

In some embodiments, an isolating layer or coating of material may be applied to the portions of the housing that would contact the connector to isolate the connector contact. The isolating layer may be very thin so as to be virtually unnoticeable. The isolating layer may have a minimal effect on the visual appearance of the device and of the port, for example by being clear or the same color as the housing, having minimal thickness, and a clean finish. The layer material or process of application may be selected to resist abrasion caused by inserting and removing the connector within the electronic device port. In some embodiments, the shape or geometry of the layer may vary (e.g., include a chamfer) to further enhance abrasion resistance. The process used for applying the layer may be applied to any suitable port geometry, including for example ports in a curved surface (e.g., a curved edge of an electronic device).

Figure 1:
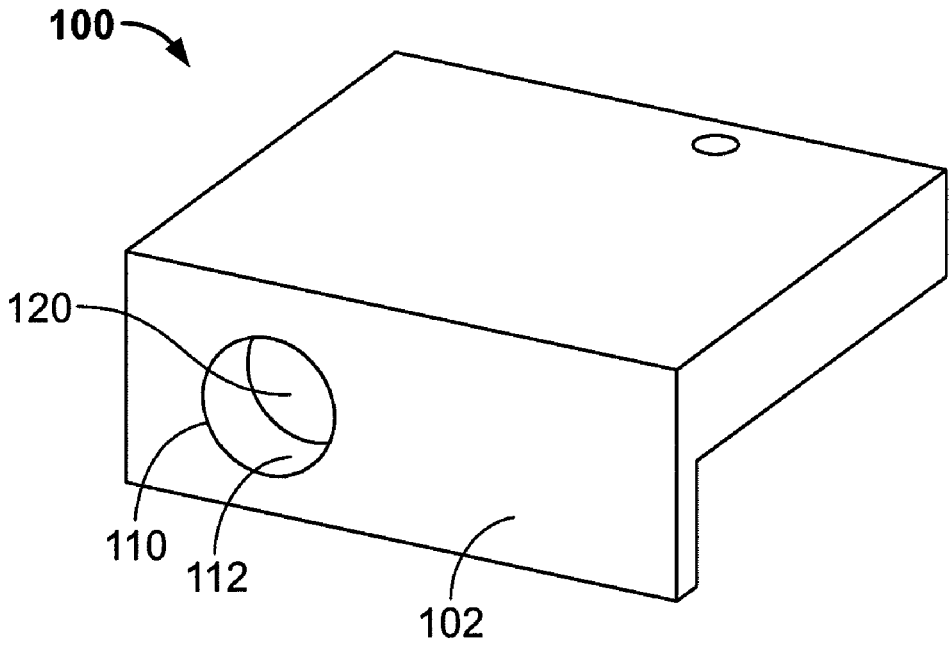
FIG. 1 is a schematic view of an illustrative housing and port having no trim in accordance with one embodiment of the invention.

FIG. 1 is a schematic view of an illustrative housing and port having no trim in accordance with one embodiment of the invention. Housing 100 may include outer surface 102 visible to the user. Outer surface 102 may include port 110 into which a connector may be inserted. Connector housing 120 may be placed within housing 100 and aligned with port 110 such that a connector passing through port 110 may engage connector housing 120. Connector housing 120 may not extend all the way to out outer surface 102 such that area 112 of housing 100 may define a portion of port 110. This may provide an aesthetically pleasing housing, as the visible portions of port 110 may have the same appearance as housing 100 (e.g., they are constructed from the same material and as part of the housing).

Figure 2:
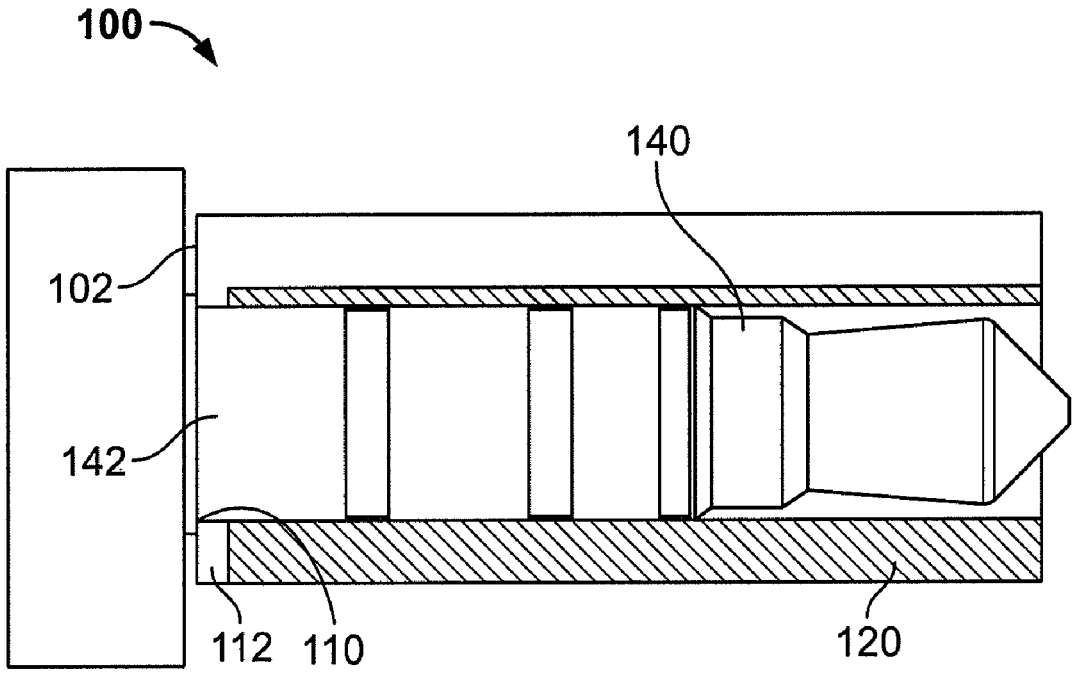
FIG. 2 is a schematic view of the illustrative housing of FIG. 1 into which a connector is inserted in accordance with one embodiment of the invention.

FIG. 2 is a schematic view of the illustrative housing of FIG. 1 into which a connector is inserted in accordance with one embodiment of the invention. Connector 140 may include several conductive portions operative to provide or detect different electrical signals. For example, different conductive portions of connector 140 may be operative to be coupled with or contact distinct conductive portions extending through connector housing 120 (e.g., electrical contacts aligned with connector conductive portions within the connector housing). In some embodiments, connector 140 may include conductive portion 142 located adjacent to outer surface 102 when connector 140 is inserted in connector housing 120. When housing 100 is constructed from a metal or other conductive material, conductive portion 142 may come into contact with area 112 of housing 100, which may adversely affect the operation of connector 140.

Connector 140 may include any suitable type of connector. For example, connector 140 may include an audio connector such as an audio jack. The audio connector may include any suitable number of conductive portions, including for example at least three (e.g., left channel, right channel, and ground). In some embodiments, the audio connector may include one or more additional conductive portions, for example for a microphone or power. As another example, connector 140 may include a data connector such as a USB, 30-pin, Serial ATA, or any other suitable connector. The data connector may include several conductive portions or pins, including for example conductive portions for power (e.g., VCC), data transfer (e.g., D+ and D−), and ground.

When a conductive portion of connector 140 (e.g., conductive portion 142) is placed in contact with housing 100, the conductive portion may be grounded. When the conductive portion is associated with a ground, this may not cause any issues, as the conductive portion is still operating as desired (e.g., it connects to the ground). If the conductive portion is associated with a data or audio transfer, however, contacts between the conductive portion and the housing may adversely affect the transfer as a conductive path to the ground is provided. For example, an accidental contact between a microphone contact portion and the housing may cause the microphone to pick up electrical noise and reduce the clarity of audio received by the microphone. As another example, an accidental contact between a data contact portion and the housing may cause the data transfer through the data contact portion to be impeded by a conductive electrical path into the housing of the device (e.g., instead of only a path between the electronic device processor and the accessory device of the connector).

Figure 3:
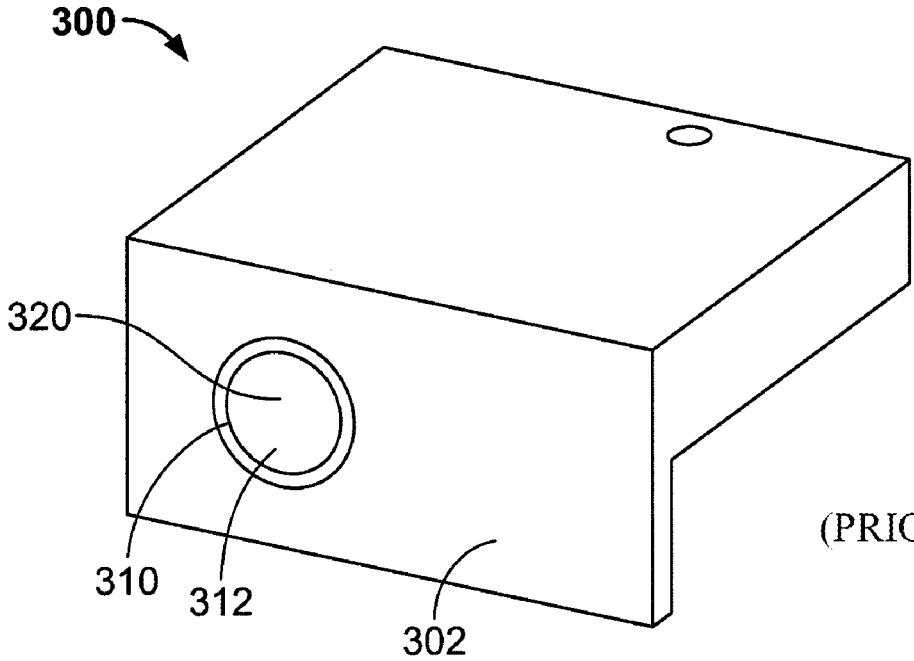
(PRIOR ART) FIG. 3
FIG. 3 is a schematic view of an illustrative housing and port having a trim in accordance with one embodiment of the invention.

Different approaches may be used to prevent contacts between conductive portion 142 and area 112 of housing 100. FIG. 3 is a schematic view of an illustrative housing and port having a trim in accordance with one embodiment of the invention. Housing 300 may include outer surface 302 visible to the user. Outer surface 302 may include port 310 into which a connector may be inserted. Connector housing 320 may be placed within housing 300 and aligned with port 310 such that a connector passing through port 310 may engage connector housing 320. Housing 300 may include trim 312 constructed from a non-conductive material and placed between connector housing 320 and outer surface 302. In some embodiments, trim 312 may be incorporated in connector housing 320. Trim 312 may provide a non-conductive layer between all portions of a connector inserted into port 310 and housing 300. This may, however, detract from the aesthetic appeal of the electronic device as a secondary component (e.g., trim 312) may be visible in the vicinity of port 310 (e.g., along the periphery of port 310). For example, a plastic trim (e.g., trim 312) may be visible in a metallic hole (e.g., port 310).

Figure 4:
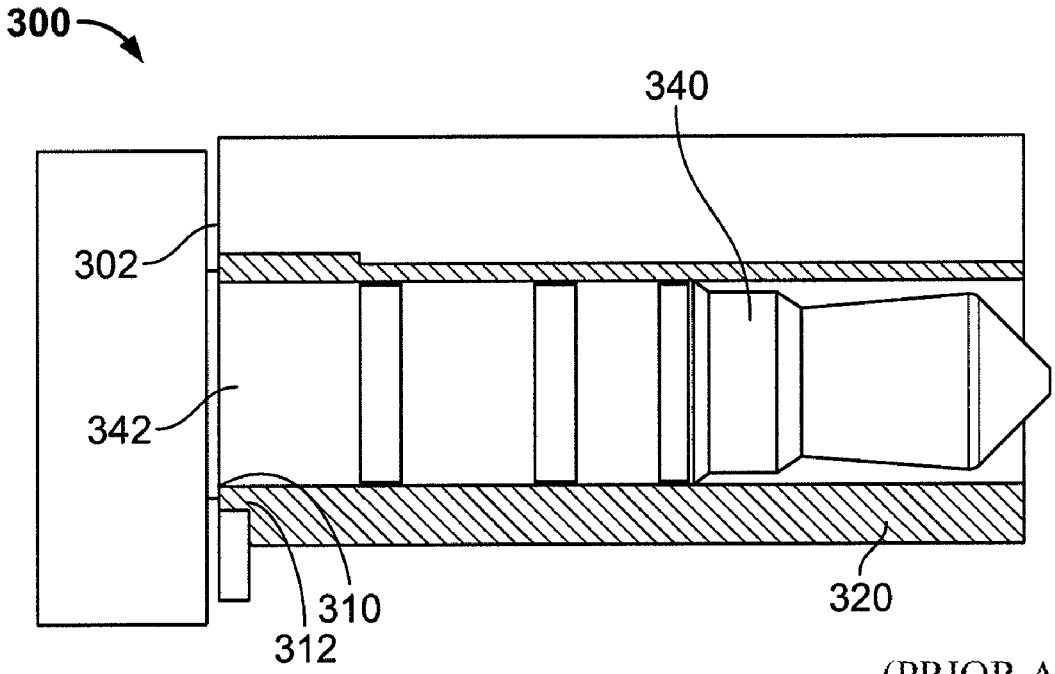
(PRIOR ART) FIG. 4
FIG. 4 is a schematic view of the illustrative housing of FIG. 3 into which a connector is inserted in accordance with one embodiment of the invention.

FIG. 4 is a schematic view of the illustrative housing of FIG. 3 into which a connector is inserted in accordance with one embodiment of the invention. Connector 340, which may include some or all of the features of connector 140 (FIG. 1), may include several conductive portions operative to provide or detect different electrical signals. In some embodiments, connector 340 may include conductive portion 342 located adjacent to outer surface 302 when connector 340 is inserted in connector housing 320. Conductive portion 342 may be isolated from housing 300 by non-conductive trim 312, which may prevent the housing from interfering with signals provided to or from conductive portion 342. The aesthetic appearance of the housing, however, may be reduced by the visible trim.

Figure 5:
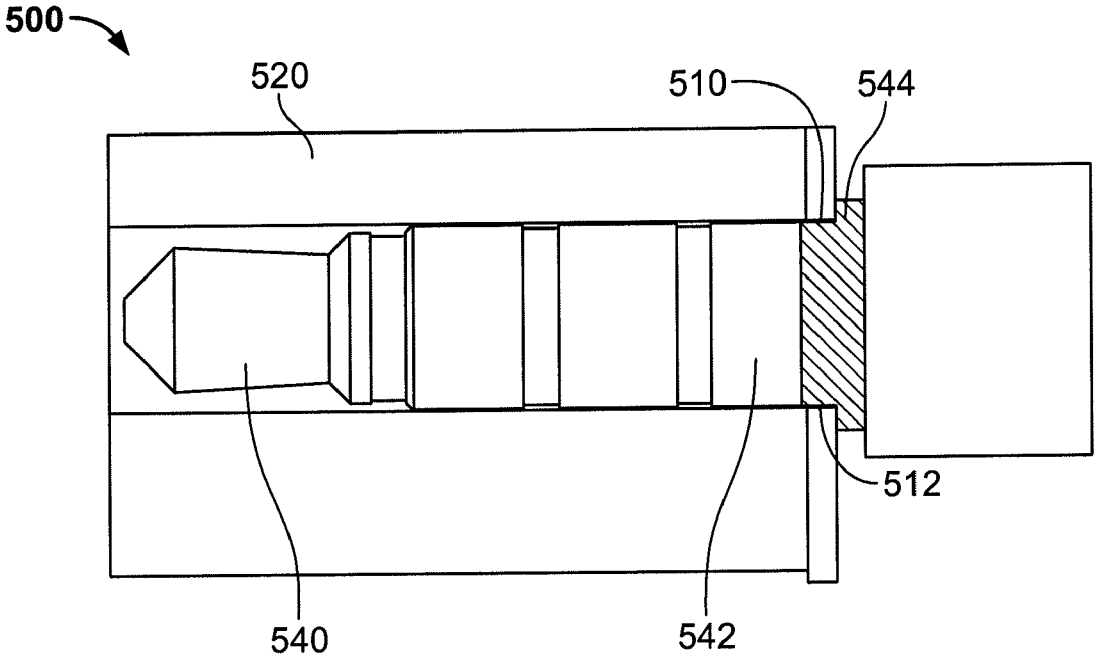
FIG. 5 is a schematic view of an illustrative connector for use with a trimless electronic device housing in accordance with one embodiment of the invention.

In some embodiments, the conductor may be isolated from the electronic device housing by modifying the connector instead of the housing or connector housing. FIG. 5 is a schematic view of an illustrative connector for use with a trimless electronic device housing in accordance with one embodiment of the invention. Housing 500 may include connector housing 520 operative to receive connector 540 via port 510. Area 512 around port 510 may include exposed housing 500 (e.g., no trim is provided between connector 540 and housing 500). Connector 540 may include conductive portion 542 operative to receive or detect an electric signal, for example from an electronic device.

To prevent electrical conductivity between connector portion 542 and area 512 of housing, connector 540 may include non-conductive flange or ring 544 manufactured around connector portion 542 such that non-conductive ring 544 is in contact with housing 500 when connector 540 is inserted into port 510. Non-conductive ring 544 may be manufactured using any suitable approach, including for example molding, shrink wrapping (e.g., shrinking a non-conductive material around a portion of connector 540), or any other suitable approach. Ring 540 may be constructed from any suitable non-conductive material, including for example plastic, rubber, an elastomer, or a ceramic material. In some embodiments, ring 540 may be finished (e.g., colored) to enhance the aesthetic appearance of connector 540.

Figure 6:
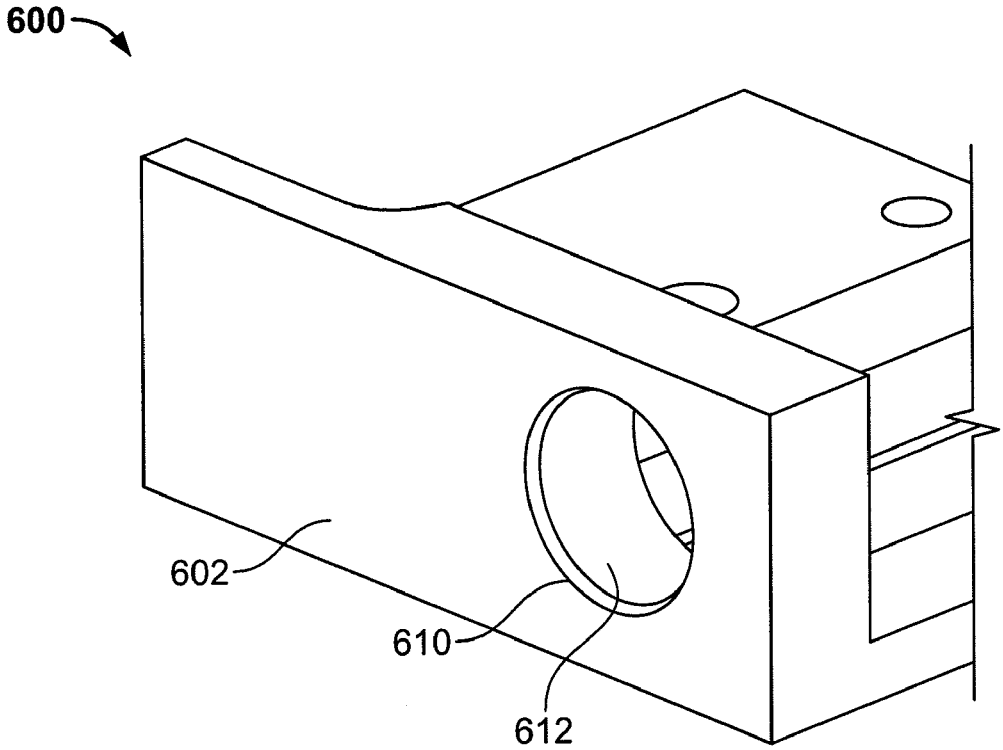
FIGS. 6 and 7 are schematic view of illustrative housings in which ports are electrically isolated without using a trim in accordance with one embodiment of the invention.
Figure 7:
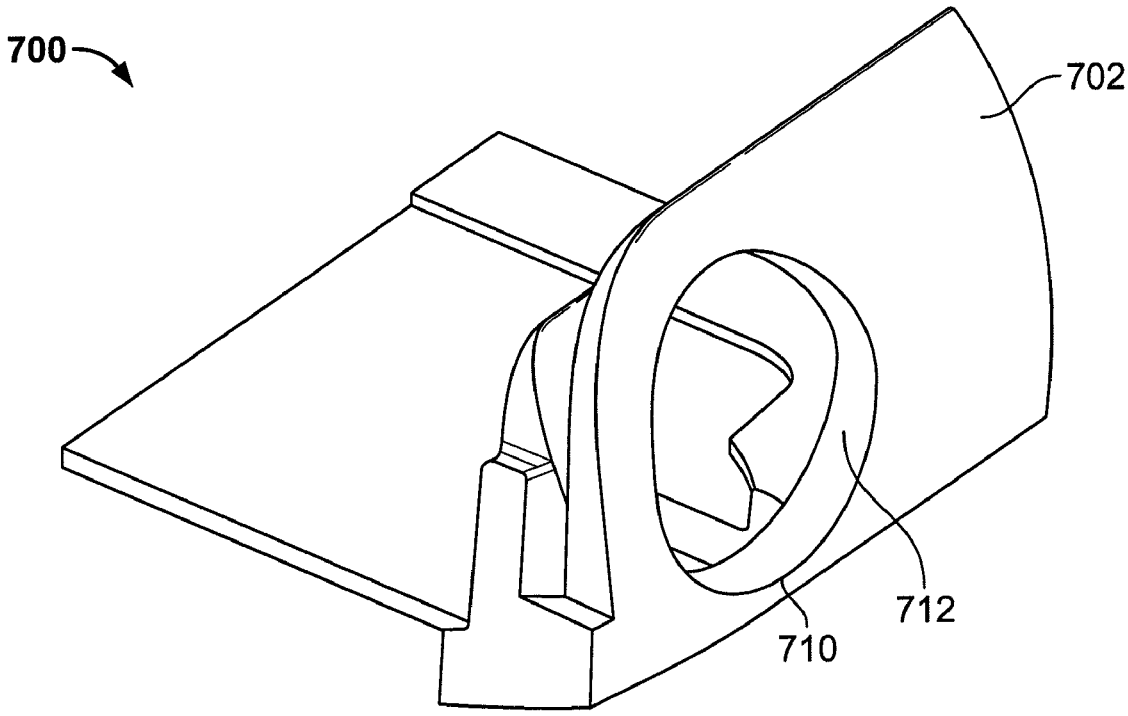

In some embodiments, a non-conductive lining may instead or in addition be applied to the area of the housing that is adjacent to the port for receiving the connector. FIGS. 6 and 7 are schematic view of illustrative housings in which ports are electrically isolated without using a trim in accordance with one embodiment of the invention. Housings 600 and 700 may include ports 610 and 710, respectively, through which a connector may pass to engage connector housings 620 and 720, respectively. Outer surface 602 and 702 of housings 620 and 720, respectively, may have any suitable shape, including for example a flat surface (e.g., as shown by outer surface 602) or a curved surface (e.g., as shown by outer surface 702).

To ensure that the conductive portion of a connector inserted in one of housings 600 and 700 does not come into contact with areas of housing 600 and 700 adjacent to and within ports 610 and 710, respectively, (e.g., with the side walls of the hole defined by the ports), housings 600 and 700 may include non-conductive layers 612 and 712, respectively. Layers 612 and 712 may include, for example, a thin non-conductive coating that may be uniformly applied to the portions of housings 600 and 700 that may come into contact with a connector inserted in ports 610 and 710, respectively (e.g., the portions of the housing within the periphery of the ports). For example, the layer may include a uniform thickness film or coating having a thickness in the range of 0.01 mm to 0.4 mm (e.g., less than 0.15 mm or less than 0.1 mm).

The layer may be constructed from any suitable material and using any suitable process. For example, a material may be applied using spraying, painting, plasma vapor deposition (PVD), chemical vapor deposition (CVD), plasma enhanced chemical vapor deposition (PECVD), UV curing, high bake curing, thin tube extrusion (e.g., coupled to the housing using an adhesive, tape, bonding, or press fit), oxidation, electrolytic deposition, electrostatic deposition, plasma electrolytic oxide (PEO) process, a thermal spray coating, or any other suitable process. Different materials may be used for each of the processes, including for example polyetheretherketone (PEEK), alumina, nitride (e.g., aluminum titanium nitride or silicon nitride), polyphenyl ether (PPE), diamond-like carbon coating (DLC), a plastic, polymer, composite material, or any other suitable material. In some embodiments, thin tube extrusion (e.g., using PEEK), coatings applied by oxidation of the base metal (e.g., oxidation of the housing metal around the periphery of the port), or electrostatic deposition of ceramic coatings may provide adequate layers adjacent to the housing port.

The material and process may be selected based on any suitable criteria. In particular, the material may be selected to be isolating (e.g., otherwise, it does not reduce undesired contacts between the connector and housing). Other criteria may include, for example, selecting the material and process based on the appearance of the resulting layer or film (e.g., select a material that is substantially clear or transparent, or a material that is substantially the same color as the housing). As another example, the material and process may be selected based on resistance to cracking, abrasive wear, or other failure (e.g., select a material and process that provide a layer operative to resist to a particular number of cycles of placing and removing a connector within the connector housing, or pulling a connector against the edges of the housing port). As still another example, the material and process may be selected for its applicability to different geometries (e.g., select a process and material that may be applied to ports in flat housings and curved housings).

In some embodiments, the edge of the material may be shaped or finished along the periphery of the port. For example, the edge may be finished to enhance resistance to wear or failure. Any suitable finish or shape may be used, including for example chamfered edges, fluted edges, fully rounded edges, and straight edges. In some embodiments, chamfered edges and fluted edges may be most resistant to failure.

The above described embodiments of the invention are presented for purposes of illustration and not of limitation, and the present invention is limited only by the claims which follow.

What is claimed is:

1. An electronic device housing, comprising:

a housing body formed from a conductive material, the housing body comprising a port extending from an external surface of the housing body into the housing body, wherein an external connector is operative to be inserted through the port to mate with an electrical component; and a non-conductive coating of a non-conductive material applied only to an area of the housing operative to come in contact with the external connector in an attempt to mate, wherein the area comprises at least a portion of the external surface to electrically insulate the external connector from the housing body.

2. The electronic device housing of claim 1, wherein the non-conductive coating is formed from at least one of:

polyetheretherketone;
alumina;
nitride;
aluminum titanium nitride;
silicon nitride;
polyphenyl ether;
diamond-like carbon coating;
a plastic;
a polymer; and
a composite material.

3. The electronic device housing of claim 1, wherein the coating is substantially transparent.

4. The electronic device housing of claim 1, wherein:

the housing body comprises an internal surface; and the electronic device housing further comprises a connector housing aligned with the port and positioned adjacent to the internal surface of the housing body, wherein the external connector is operative to engage the connector housing.

5. The electronic device housing of claim 4, wherein:

the connector housing comprises the electrical component.

6. The electronic device housing of claim 4, wherein:

the connector housing is operative to retain the external connector within the connector housing.

7. An electronic device housing, comprising:

a conductive housing body formed from a conductive material comprising an interior surface and an exterior surface, the housing body comprising an aperture extending through the housing body, the aperture comprising a sidewall extending between the interior surface and the exterior surface; and an insulating coating of an insulating material applied only to an area of the housing operative to come in contact with an external connector during mating at the aperture, wherein the area comprises at least a portion of the exterior surface, wherein the insulating coating is flush with the sidewall.

8. The electronic device housing of claim 7, wherein:

the insulating coating does not extend into the sidewall.

9. The electronic device housing of claim 7, wherein:

the aperture in the housing is operative to receive a connector, wherein the connector is placed in contact with the insulating coating when the connector is received by the aperture.

10. The electronic device housing of claim 7, wherein:
the insulating coating is visibly indistinguishable from the housing body.

11. The electronic device housing of claim 10, wherein:
the insulating coating is constructed from a transparent material.

12. The electronic device housing of claim 10, wherein:
the insulating coating is constructed from a material of the same color as the housing body.

13. An electronic device operative to provide an audio output via an audio plug, comprising:
a housing formed from a conductive material comprising an interior surface and an exterior surface, wherein the exterior surface of the housing defines an external surface of the device;
an audio jack operative to receive an audio plug, the audio jack aligned with an opening in the housing sized to receive the audio plug, wherein the opening extends between the interior surface and the exterior surface of the housing; and
an insulating coating of an insulating material applied only to an area of the housing operative to come in contact with the audio plug in an attempt to receive the audio plug, wherein the area comprises at least a portion of the exterior surface of the housing.

14. The electronic device of claim 13, wherein:
the insulating coating is applied to portions of the external surface that are adjacent to the opening.

15. The electronic device of claim 13, wherein:
the audio jack is positioned adjacent to the interior surface of the housing.

16. The electronic device of claim 13, wherein the audio jack further comprises:
at least one electrical connector operative to mate with the audio plug to establish a communications path for audio through the audio plug.

17. The electronic device of claim 13, wherein:
the insulating coating has a thickness of less than 0.1 mm.

18. The electronic device of claim 13, wherein:
the audio jack comprises a 3.5 mm audio jack; and
the audio plug comprises a 3.5 mm audio plug.

19. An electronic device, comprising:
a conductive housing formed from a conductive material comprising at least one port having a perimeter formed in a wall of the housing through which an external connector may pass, the port further defined by a sidewall surface which lies between outer and inner surfaces of the electronic device housing wall;
a connector housing operative to receive the external connector, the connector housing aligned with the port hole and comprising at least one electrical connector such that mating between the external connector and the at least one electrical connector is possible; and
a non-conductive thin coating of a non-conductive material applied only to an area of the housing operative to come in contact with the external connector in an attempt at said mating, wherein the area comprises the wall around the perimeter of the port, wherein the thin coating is less than 0.1 mm thick.

* * * * *